US005148585A

United States Patent [19]

Jaeger

[11] Patent Number: 5,148,585

[45] Date of Patent: Sep. 22, 1992

[54] DEVICE FOR MANIPULATING DROP WIRES FOR WARP-THREAD DRAWING-IN MACHINES

[75] Inventor: Silvio Jaeger, Mauren, Switzerland

[73] Assignee: Zellweger Uster AG, Uster, Switzerland

[21] Appl. No.: 702,020

[22] Filed: May 17, 1991

[30] Foreign Application Priority Data

May 18, 1990 [CH] Switzerland ..... 01694/90

[51] Int. Cl.[5] ..... D03J 1/14

[52] U.S. Cl. ..... 28/205; 28/204; 28/201

[58] Field of Search ..... 28/203, 204, 205, 208, 28/201

[56] References Cited

U.S. PATENT DOCUMENTS

| | | | |
|---|---|---|---|
| 750,300 | 1/1904 | Oldfield | 28/205 |
| 4,549,333 | 10/1985 | Stähl | 28/205 |
| 4,891,871 | 1/1990 | Tachibana et al. | 28/205 |

FOREIGN PATENT DOCUMENTS

| | | | |
|---|---|---|---|
| 0298616 | 1/1989 | European Pat. Off. . | |
| 1022823 | 3/1950 | France | 28/208 |
| 2239548 | 2/1975 | France . | |
| 391614 | 9/1965 | Switzerland | 28/205 |
| 653386 | 5/1951 | United Kingdom | 28/205 |
| 684324 | 12/1952 | United Kingdom | 28/205 |

*Primary Examiner*—Werner H. Schroeder
*Assistant Examiner*—Bibhu Mohanty
*Attorney, Agent, or Firm*—Burns, Doane, Swecker & Mathis

[57] ABSTRACT

The apparatus includes magazines (16) for accommodating drop-wire stacks (LA) and transport mechanisms for feeding the drop-wire stacks (LA) to a separating station where the drop wires are singularized. The transport means contain a first path (11) for feeding the full magazines (16) to the separating station and a second path (21) for returning the empty magazines (16) from the separating station. In addition, mechanisms (22, 33) are provided for transferring the empty magazines from the first to the second path. Largely automatic feeding of the warp-thread drawing-in machine with drop wires is made possible by this device.

19 Claims, 6 Drawing Sheets

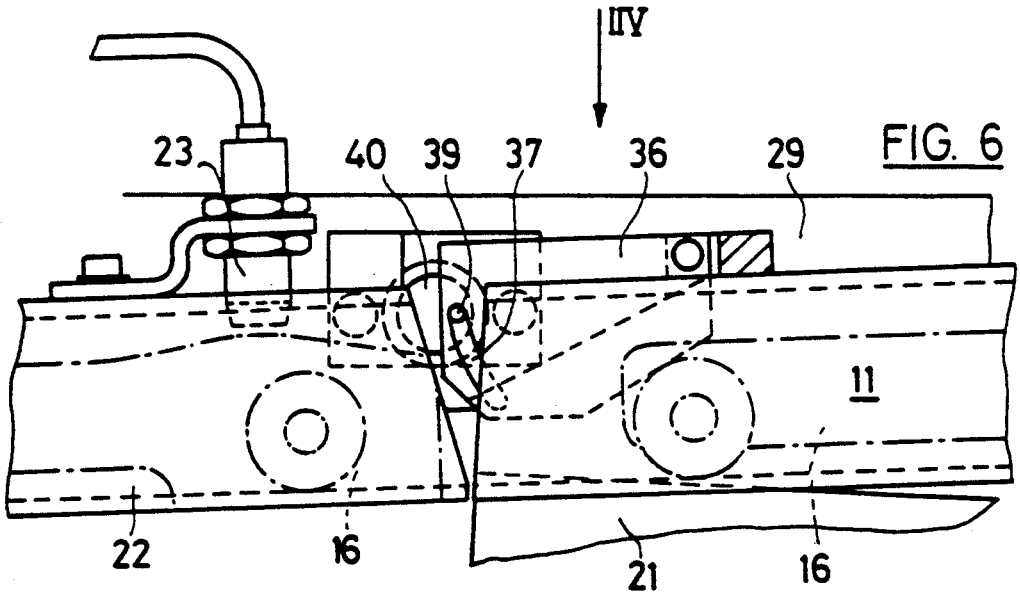
FIG. 6
FIG. 7
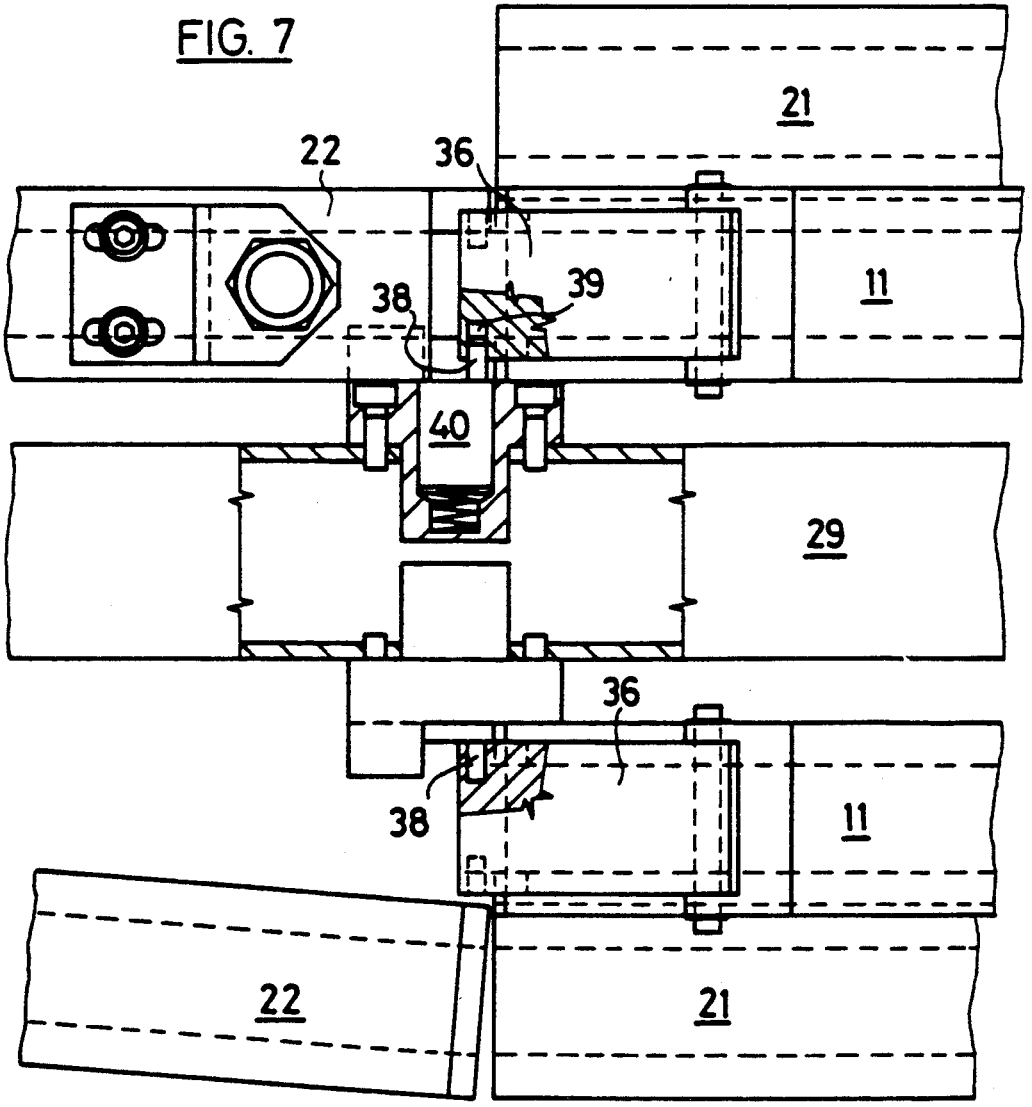

DEVICE FOR MANIPULATING DROP WIRES FOR WARP-THREAD DRAWING-IN MACHINES

BACKGROUND AND FIELD OF INVENTION

The present invention relates to apparatus for manipulating drop wires for warp-thread drawing-in machines used for preparing loom harnesses. The apparatus includes means for storing the drop wires and transport means for feeding them to a separating station where the drop wires are singularized for the purpose of preparing them for the drawing-in of the warp threads.

In the warp-thread drawing-in machine sold under the trademark USTER DELTA of Zellweger Uster AG and disclosed by U.S. Pat. No. 3,681,815, the drop wires are manipulated in such a way that they are inserted with one of their ends into a sectional rail and are then clamped together with a type of screw clamp to form a compact stack. These stacks are then lined up on supporting rails of a drawing-in truck which carries a warp beam and a clamped warp-thread layer. The truck is moved past the drawing-in machine and in this sense acts as transport means for the drop wires. Since the stacks have only a relatively short length, refilling with new stacks is necessary when there are high numbers of threads. This is associated with undesirable stoppages of the drawing-in machine.

SUMMARY AND OBJECTS OF THE INVENTION

An aspect of the present invention is the provision of apparatus for manipulating drop wires for warp-thread drawing-in machines so as to enable uninterrupted automatic feeding of the warp-thread drawing-in machine with drop wires.

In an apparatus according to the invention, magazines for accommodating drop-wire stacks are provided for storing the drop wires. The magazines are transported by means having a first path for feeding the full magazines to the separating station and a second path for returning the empty magazines from the separating station, and means are provided for transferring the empty magazines from the first to the second path.

In using a device according to the invention, the full magazines merely need to be transferred to the first path and the empty magazines removed from the second path; the entire processing of the drop wires takes place fully automatically.

In a preferred exemplary embodiment, the first path contains a feed rail sloping down towards the separating station, and the second path contains a return rail sloping down away from the separating station. The hand magazines are guided in a rolling or sliding manner in the feed and return rails.

According to a preferred further development, two pairs of feed and return rails are provided, and a means for transferring the empty magazines is allocated to each of these pairs. The use of two pairs of feed and return rails opens up the possibility of processing two different types of drop wire (for example thick and thin drop wires). This may be necessary in the case of certain fabrics (e.g. in the case of hairline stripe) but such was not possible heretofore in automatic drawing-in machines. This is a quite considerable advantage over all hitherto known automatic drawing-in machines.

BRIEF DESCRIPTION OF THE DRAWINGS

The invention is described in greater detail below with reference to an exemplary embodiment and to drawings, in which.

Figure 3:
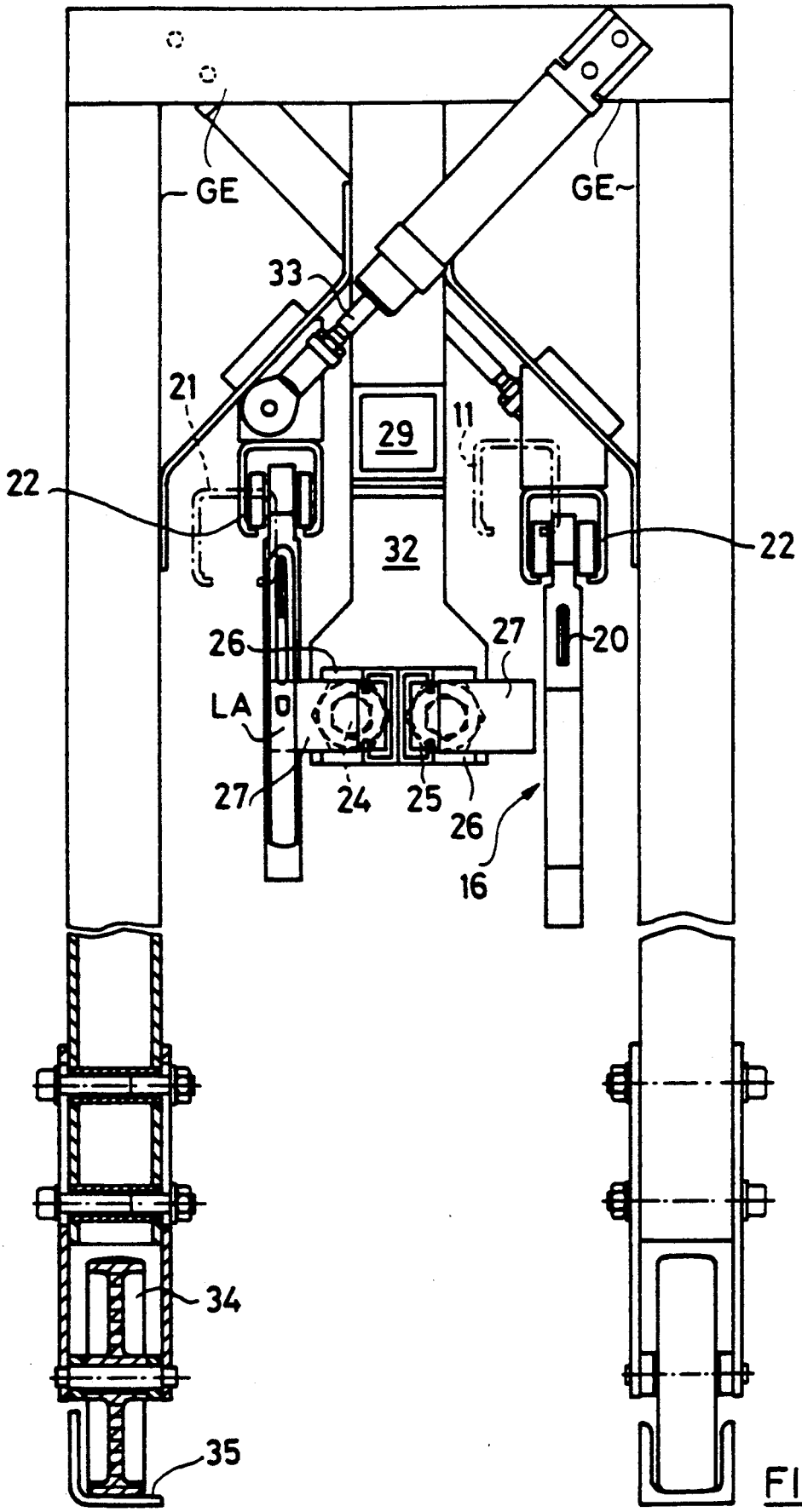

FIGS. *2a* and *2b* show a side view of a device according to the invention for manipulating drop wires;

FIG. 3 shows a view in the direction of arrow III in FIG. *2a;*

Figure 4:
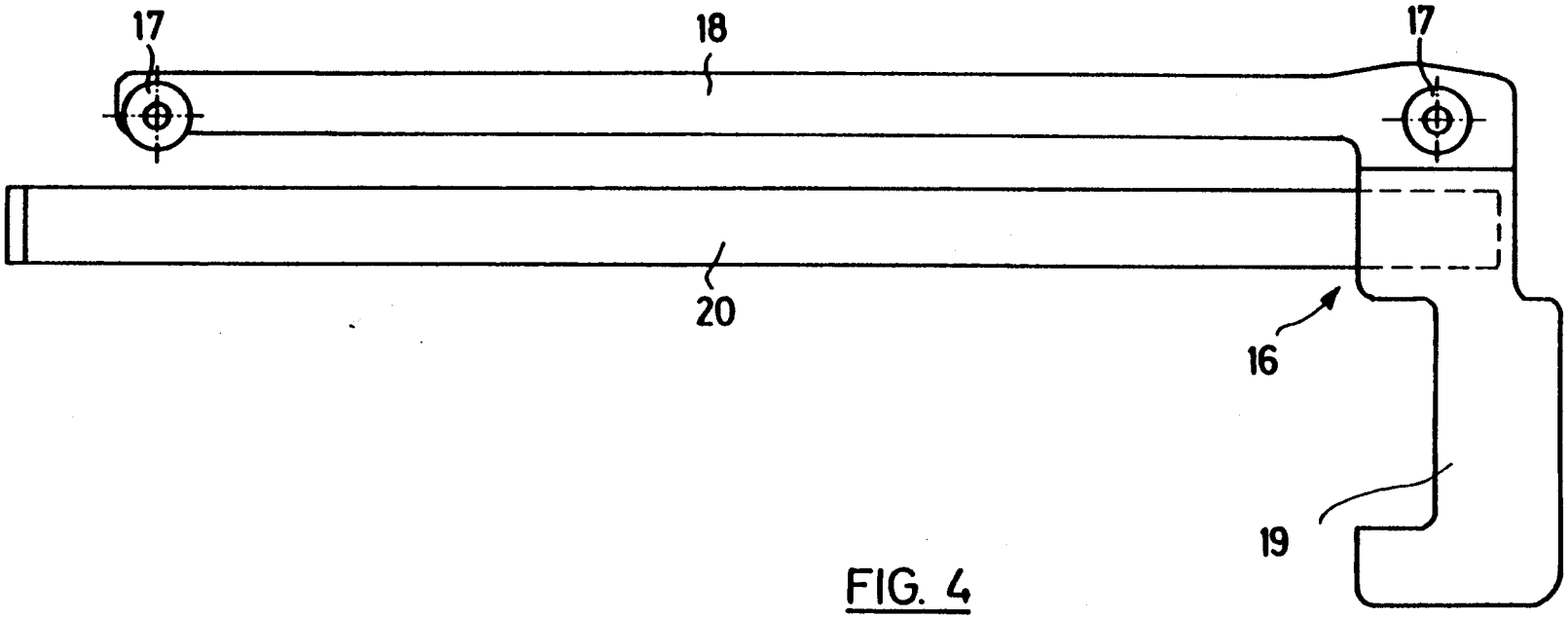

FIG. 4 is an elevational view of a magazine for the apparatus of FIGS. *2a* and *2b;*

Figure 5:
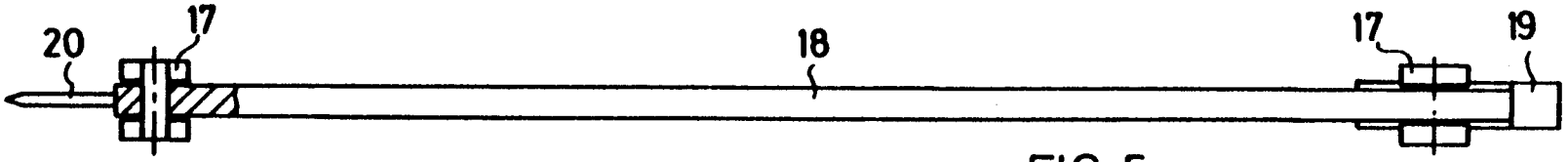

FIG. 5 is a top view of the magazine of FIG. 4;

FIG. 6 shows a further detail of FIG. *2a*; and

FIG. 7 shows a view in the direction of arrow VII in FIG. 6.

DETAILED DESCRIPTION OF PREFERRED EMBODIMENTS

Figure 1:
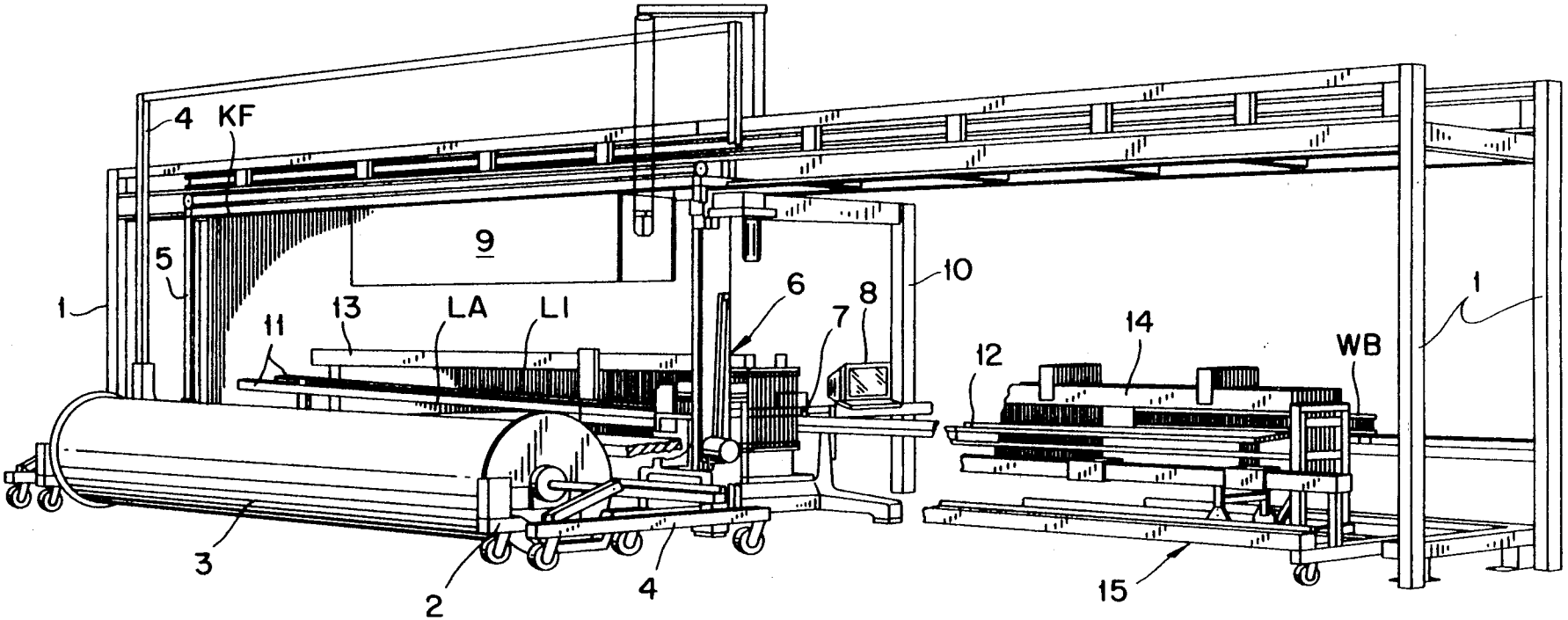
FIG. 1 shows a perspective overall representation of a warp-thread drawing-in machine.

According to FIG. 1, the drawing-in machine includes a mounting stand 1 and various subassemblies arranged in this mounting stand 1. Each of the subassemblies forms a functional module. A warp-beam truck 2 with a warp beam 3 arranged thereon can be recognized in front of the mounting stand 1. In addition, the warp-beam truck 2 contains a lifting device 4 for holding a frame 5, on which the warp threads KF are clamped. This clamping is effected before the actual drawing-in and at a location separate from the drawing-in machine, the frame 5 being positioned at the bottom end of the lifting device 4 directly next to the warp beam 3. For the drawing-in, the warp-beam truck 2 together with warp beam 3 and lifting device 4 is moved to the so-called setting-up side of the drawing-in machine and the frame 5 is lifted upwards by the lifting device 4 and it then assumes the position shown.

The frame 5 and the warp beam 3 are displaced in the longitudinal direction of the mounting stand 1. During this displacement, the warp threads KF are directed past a thread-separating group 6 and as a result are separated and selected. After the selection, the warp threads KF are cut off and presented to a drawing-in needle 7, which forms a component of the so-called drawing-in module. The selecting device used in the warp tying machine sold under the trademark USTER TOPMATIC of Zellweger Uster AG can be used, for example, for the selection of the warp threads.

Next to the drawing-in needle 7 is a video display unit 8, which belongs to an operating station and serves to display machine functions and machine malfunctions and to input data. The operating station, which forms part of a so-called programming module, also contains an input stage for the manual input of certain functions, such as, for example, creep motion, start/stop, repetition of operations, and the like. The drawing-in machine is controlled by a control module which contains a control computer and is arranged in a control box 9. Apart from the control computer, this control box contains a module computer for every so-called main module, the individual module computers being controlled and monitored by the control computer. The main modules of the drawing-in machine, apart from the modules already mentioned (that is, the drawing-in module, the yarn module, the control module and the programming module) are the heald, drop-wire, and reed modules.

The thread-separating group 6, which presents the warp threads KF to be drawn in to the drawing-in needle 7, and the path of movement of the drawing-in needle 7, which runs vertically to the plane of the clamped warp threads KF, define a plane in the area of a support 10 forming part of the mounting stand 1, which plane separates the setting-up side already mentioned from the so-called taking-down side of the drawing-in machine. The warp threads and the individual elements in which the warp threads are to be drawn in are fed at the setting-up side, and the so-called harness (healds, drop wires and reed) together with the drawn-in warp threads can be removed at the taking-down side. During the drawing-in, the frame 5 having the warp threads KF and the warp-beam truck 2 having the warp beam 3 are moved to the right past the thread-separating group 6, in the course of which the drawing-in needle 7 successively removes from the frame 5 the warp threads KF clamped on the latter.

When all warp threads KF are drawn in and the frame 5 is empty, the latter, together with the warp-beam truck 2, the warp beam 3 and the lifting device 4, is located on the taking-down side.

Arranged directly behind the plane of the warp threads KF are the warp-stop-motion drop wires LA. Behind the latter are the healds LI and further to the rear is the reed. The drop wires LA are stacked in hand magazines and the full hand magazines are hung in sloping feed rails 11, on which they are transported to the right towards the drawing-in needle 7. At this location they are separated and moved into the drawing-in position. Once drawing-in is complete, the drop wires LA pass on drop-wire supporting rails 12 to the taking-down side.

The healds LI are lined up on rails 13 and shifted manually or automatically on the latter to a separating stage. The healds LI are then moved individually into their drawing-in position and, once drawing-in is complete, are distributed over the corresponding heald shafts 14 on the taking-down side. The reed is likewise moved step-by-step past the drawing-in needle 7, the corresponding reed gap being opened for the drawing-in. After the drawing-in, the reed is likewise located on the taking-down side. A part of the reed WB can be recognized to the right next to the heald shafts 14. This representation is to be understood purely as an illustration, since the reed, at the position shown of the frame 5, is of course located on the setting-up side.

As also shown in FIG. 1, a so-called harness truck 15 is provided on the taking-down side. This harness truck 15, together with the drop-wire supporting rails 12, heald shafts 14 and holder for the reed, fixed thereon, is pushed into the mounting stand 1 into the position shown and, after the drawing-in, carries the harness having the drawn-in warp threads KF. At this moment, the warp-beam truck 2 together with the warp beam 3 is located directly in front of the harness truck 15. By means of the lifting device 4, the harness is now reloaded from the harness truck 15 onto the warp-beam truck 2, which then carries the warp beam 3 and the drawn-in harness and can be moved to the relevant weaving machine or into an intermediate store.

The functions described are distributed over a plurality of modules which represent virtually autonomous machines which are controlled by a common control computer. The cross-connections between the individual modules run via this higher-level control computer and there are no direct cross-connections between the individual modules. The main modules already mentioned of the drawing-in machine are themselves of modular construction and as a rule consist of submodules. This modular construction is described in Swiss Patent Application No. 03,633/89-1, to the disclosure of which reference is expressly incorporated herein by reference.

Figure 2A:
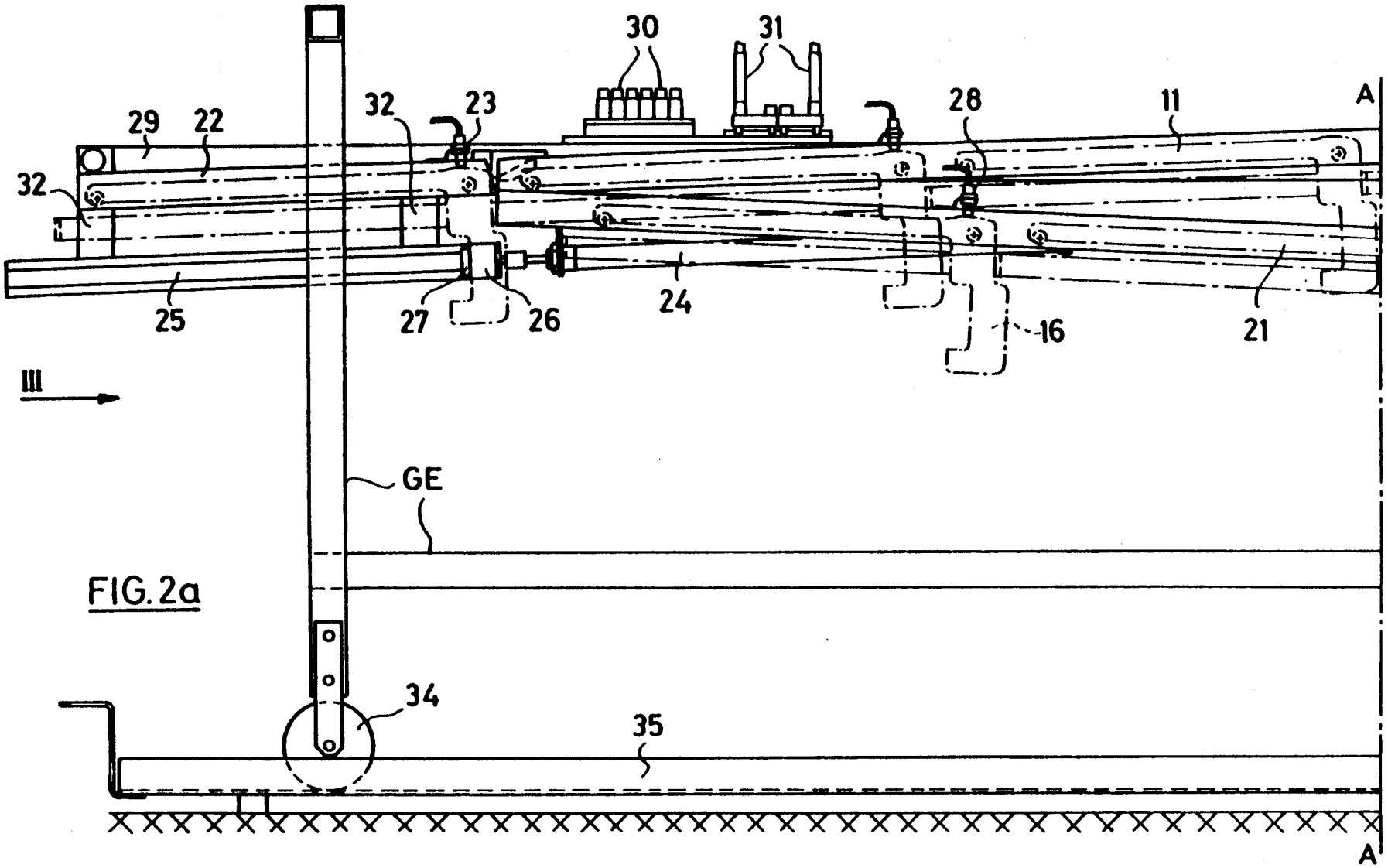
Figure 2B:
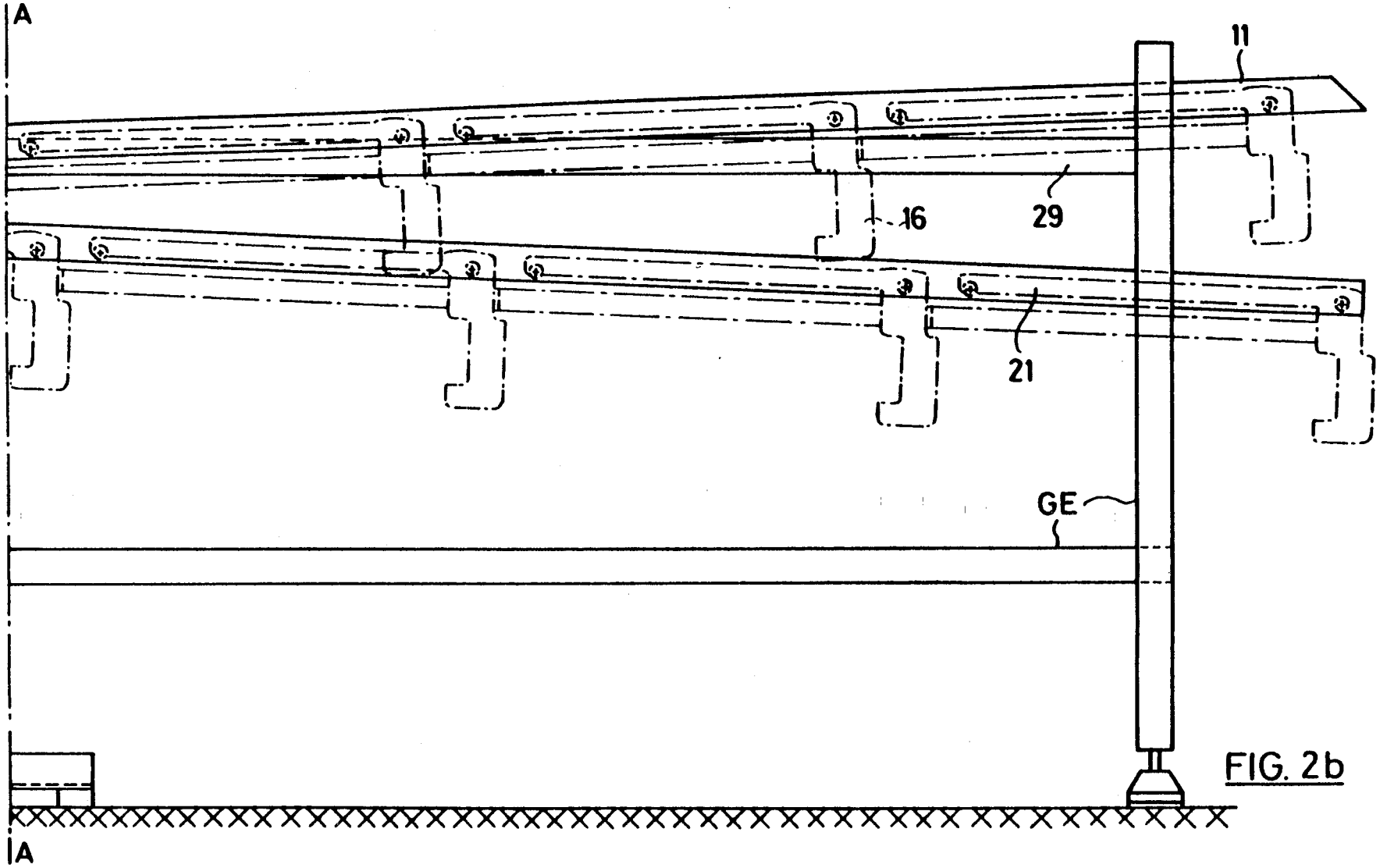

The drop-wire storing submodule of the drop-wire module will now be described below. FIGS. 2*a*, 2*b* and 3 show an overall representation of this submodule in a side view (FIGS. 2*a* and 2*b*) and in a front view (FIG. 3) in the direction of arrow III in FIG. 2*a*. The side view is spread over two sheets; FIGS. 2*a* and 2*b* are to be understood as being adjacent along line A—A on the extreme right in FIG. 2*a* and on the extreme left in FIG. 2*b*.

As can be understood from the drawings, the drop-wire storing submodule essentially consists of a movable elongated stand GE in which the feed rails 11 for the hand magazines having the drop wires LA (FIG. 1) are mounted. Relative to FIG. 1, the submodule in FIGS. 2*a* and 2*b* is turned through 180°; its overall length is about 3 meters.

The feed rails 11 are formed by sectional rails of C-shaped cross-section in which elongated hand magazines 16 are hung. As can be understood in particular from FIGS. 4 and 5, these hand magazines 16 include a rail 18 carrying transport rollers 17, a handle 19 connected to the rail 18 and a drop-wire bar 20 which is connected to the handle 19 and on which the drop wires LA are lined up. The feed rails 11 slope down from the loading side of the submodule to its unloading side, that is, the separating station where the drop wires LA are singularized, so that the hand magazines 16 loaded with drop wires LA therefore roll by themselves to the separating station, which is located at the left hand end of the submodule in FIG. 2.

Apart from the feed rails 11 for feeding the full hand magazines 16 to the separating station, return rails 21 for returning the empty hand magazines from the separating station to the loading side are provided in the stand GE. These return rails 21 slope down away from the separating station so that the empty hand magazines 16 roll back by themselves. As will be described later with reference to FIGS. 6 and 7, the empty hand magazines are transferred to the return rails 21 directly in front of the separating station. For this purpose, the frontmost part of the magazine feed and return paths adjoins the separating station and is designed as a swivel rail 22 which can be alternatively swiveled into the feed or return path and whose length corresponds to the length of a hand magazine 16. There is thus always only one hand magazine 16 in the swivel rail 22, its entry into and delivery from the swivel rail being detected by sensors 23 and 28 respectively In the version shown, two pairs of feed and return rails 11 and 21 respectively are provided, but it is of course possible to use only one pair. Two pairs offer the possibility of processing two types of drop wires, and that is a substantial advantage over all hitherto known automatic drawing-in machines.

The hand magazine 16 in the swivel station 22 runs with the tip of its rail 18 (FIG. 4) against a stop and is thereby fixed in the swivel rail. The individual drop-wires LA are transferred to the separating station the details of which are disclosed more fully in Swiss Patent Application No. 02 699/90-9 the disclosure of which is incorporated herein by reference. The transfer is effected by displacing the drop-wire stack, lined up on the drop-wire bar 20, towards the free end of the latter.

This displacement is effected by a pneumatic cylinder 24 which drives a plunger 26 guided in a C-section 25. At its front part pressing against the drop-wire stack, this plunger is provided with a driving finger 27 of hinge-like design. The driving finger is held by spring force in its working position in which it projects away from the plunger 26 at right angles and presses against the drop wires LA. When a drop-wire stack has been processed and the relevant hand magazine 16 emptied, the linear cylinder 24 is fully extended and the plunger 26 having the driving finger 27 is in its frontmost position.

The swivel rail 22 is now swiveled into the return path, as a result of which the empty hand magazine 16 is transferred to the return rail 21 and rolls back to the right towards the feeding side of the drop-wire module. This movement is monitored by a sensor 28 on the return rail 21. As soon as this sensor 28 detects that a hand magazine 16 is rolling past, the swivel rail 22 is swiveled into the feed path so that a new full hand magazine 16 can roll into the swivel rail 22. At the same time, the plunger 26 having the driving finger 27 is still in its frontmost position. After the sensor 23 has detected the presence of a new hand magazine 16 in the swivel rail 22, the pneumatic cylinder 24 is retracted. As a result, the driving finger 27 runs against the drop wires LA and, on account of its hinge-like fastening to the plunger 26, is pushed to the side to such an extent that it can slide along the drop wire.

As can be understood from FIGS. 2*a*, 2*b* and 3, the stand GE has a central longitudinal rail 29 on which electrical connections 30 for the various sensors and pneumatic connections 31 for the various pneumatically driven adjusting members are arranged. In addition, bearers 32 for the C-sections 25 are fastened to the central longitudinal rail 29. At its end face adjacent to the separating station, each swivel rail 22 is suitably articulated on the central longitudinal rail 29 for movement to enable the opposite end of the rail to be shifted between its various positions of operation. Structures providing the appropriate movement of the front end of the rail will be readily apparent to those skilled in the art. For example, the front end of the rail may be affixed to a mounting member which, in turn, is rotatably received in a jaw-like holder in order to enable the mounting member (and rail) to swivel within the holder. Horizontal pivoting generally perpendicularly to the front-to-rear direction of the rail may be accommodated to enable the rear end of the rail 22 to move vertically relative to the front end thereof. A certain amount of lateral play between the mounting member and the holder enables the necessary horizontal movement of the rail.

Adjustment of the position of the rear end of the swivel rail 22 may be accomplished via a pneumatically driven cylinder fastened to the stand GE. As shown in FIG. 3, the cylinder 33 moves a carrier T for the other end portion of the rail 22 along an inclined guide G extending parallel to the axis of the cylinder 33. FIG. 3 shows the various positions of the two swivel rails 22, the swivel positions, for clearer representation, being drawn approximately in the area of the sensor 23, that is, at the location of maximum deflection of the swivel rails 22. That is the location where the rear end of each swivel rail 22 is in alignment with the associated feed and return rails 11 and 21 respectively. In the left hand part of the figure, the swivel rail 22 is in the fully extended position in the feed path; the position drawn in chain lines corresponds to the return path. In the right hand part of FIG. 3, the swivel rail 22 is in the fully extended position in the return path; the position drawn in chain lines corresponds to the feed path. Accordingly, the left hand half shows a full hand magazine 16 having drop wires LA which are pushed by the pneumatic cylinder 24 via plunger 26 and driver 27 towards the viewer. The right hand half shows an empty hand magazine 26 whose drop wires have already been processed.

The stand GE is provided with wheels 34 which run in corresponding rails 35. The stand GE and thus the entire drop-wire module is mobile on the one hand, that is, it can be moved into and out of the drawing-in machine, and on the other hand it can be fixed in its working position in the drawing-in machine.

FIGS. 6 and 7 show the connection between the feed and return rails 11 and 21 respectively on the one hand and the swivel rail 22 on the other hand, FIG. 6 showing an enlarged detail from FIG. 2*a* and therefore a side view, and FIG. 7 showing a plan view in the direction of arrow VII in FIG. 6.

According to the representation, a pivotable stop flap 36 for the hand magazine 16 is arranged on the end of the feed rails 11 facing the swivel rail 22. Milled in this stop flap is a curved groove 37 in which a locking pin 38 engages and which has at its upper end a step 39 deepened relative to the base of the groove. The locking pin 38 is arranged on one end face of a cylinder 40 mounted in a spring-loaded manner in a bore in the central longitudinal rail 29 and its length corresponds to the depth of groove 38 plus step 39.

When the swivel rail 22 lies in the return path and is directed towards the return rail 21 (FIG. 7, bottom half), the locking pin 38 projects with its entire length into groove 37 and step 39 and thereby locks the stop flap 36, as a result of which the frontmost hand magazine 16 in the adjacent feed rail 11 in the transport direction is prevented from rolling further (FIG. 6). When the swivel rail 22 is then swiveled into the feed path and is aligned with the feel rail 11 (FIG. 7, top half), the swivel rail 22, with its side surface facing the central longitudinal rail, strikes the cylinder 40 and presses the latter against the force of its spring into its mounting bore, as a result of which the locking pin 38 is pulled out of the step 39 of the groove 37. The corresponding adjusting travel of cylinder 40 and locking pin 38 is slightly larger than the depth of the step 39 so that the locking pin 38 definitely no longer projects into the step and thus the stop flap 36 is no longer locked. Consequently, the stop flap 36 is pushed up by the frontmost hand magazine 16 and the latter can roll into the swivel rail 22. As soon as the drop wires of the hand magazine have been processed and the swivel rail 22 swivels into the return path for transferring the now empty hand magazine to the return rail 21, the pressure of the swivel rail 22 on the cylinder 40 is lifted, and the locking pin 38 can again engage in the step 39 and lock the stop flap 36.

In its working position, the drop-wire module is detachably coupled to the drawing-in machine. The feeding with full magazines and the removal of the empty magazines takes place in this working position in the drawing-in machine, from which the drop-wire truck is removed only for maintenance or service work.

I claim:

1. A device for manipulating drop wires from warp-thread drawing-in machines, the device comprising a loading side and an unloading side and having means for storing the drop wires and transport means for feeding them to the unloading side where the drop wires ar offered to a separating station for singularizing them, wherein the means for storing the drop wires (LA) have magazines (16) for accommodating drop-wire stacks and the transport means have a first path (11) for feeding the full magazines to the unloading side and a second path (21) for returning the empty magazines from the unloading side, and wherein means (22, 33) are provided for transferring the empty magazines from the first to the second path.

2. A device according to claim 1, wherein the first path contains a feed rail (11) sloping down towards the unloading side, and the second path contains a return rail (21) sloping down away from the unloading side, and wherein the hand magazines (16) are guide din a rolling or sliding manner in the feed and return rails.

3. A device according to claim 2, wherein the hand magazines (16) are of pistol-like design and have a handle (19) as well as a rail (18) having transport rollers (17), which rail (18) projects away from the handle (19), and a drop-wire bar (20) for accommodating the drop wires (LA).

4. A device according to claim 2, wherein the frontmost part of the feed and return rails (11 and 21 respectively), which frontmost part adjoins the unloading side, is designed as a swivel rail (22) which can alternatively be swiveled into the first or second path.

5. A device according to claim 4, wherein the length of the swivel rail (22) corresponds to that of a hand magazine (16).

6. A device according to claim 5, wherein a mobile stand (GE) which can be coupled to the warp-thread drawing-in machine and in which the feed and return rails (11 and 21) as well as the swivel rail (22) are arranged, one swivel rail being allocated to each pair of feed and return rails.

7. A device according to claim 6, wherein a member for displacing the respective drop-wise stack (LA) towards the unloading side is provided in the area of each swivel rail (22).

8. A device according to claim 7, wherein the said member has a plunger (26) pressing from the rear against the drop-wire stack.

9. A device according to claim 8, wherein the plunger (26) is pneumatically driven and is displaceable parallel to the drop-wire stack (LA) and bears a driving finger (27) which projects into the path of movement of the drop wires and can be swung out of this path of movement.

10. A device according to claim 6, wherein each swivel rail (22) is mounted in an articulated manner at its one end adjacent to the unloading side and is connected at a distance from this end to an adjusting member (33), upon activation of which the swivel rail is moved in such a way that its other end is alternatively, in alignment with the feed and return rails (11 and 21 respectively) so that the swivel rail assumes either the feed or return position.

11. A device according to claim 10, wherein the feed rail (11), at its end facing the swivel rail (22), has a holding means which blocks the hand magazines (16) when the swivel rail is in the return position.

12. A device according to claim 11, wherein the holding means is formed by a stop flap (36) which projects into the path of the hand magazines (16) and which can be moved when the swivel rail (22) is in the feed position and is blocked when the swivel rail (22) is in the return position.

13. A device according to claim 12, wherein a locking pin (38) which can be actuated during the adjusting of the swivel rail (22) between its two positions and which blocks the stop flap (36) when the swivel rail is in the return position and releases the stop flap (36) when the swivel rail is in the feed position.

14. A device according to claim 6, wherein the stand (GE) has transport wheels (34) which are guided in rails (35).

15. A device according to claim 10, wherein sensors (23, 28) for monitoring the presence of hand magazines (16) in the swivel rail (22) and in the feed and return rails (11 and 21 resp.).

16. A device according to claim 2, wherein two pairs of feed and return rails (11 and 21) are provided, a means (22, 33) for transferring the empty magazines (16) being allocated to each of these pairs.

17. Drop wire storing and transport apparatus for a warp-thread drawing-in machine, comprising magazines for accommodating stacks of drop wires; and transport means for transporting the magazines filled with drop wires to an unloading position where the drop wires may be removed from the magazines and for transporting emptied magazines from said unloading position; said transport means including means establishing a first path over which full magazines are fed toward said unloading position, means establishing a second path over which empty magazines are returned from said unloading position, and means for transferring magazines from said first path to said second path.

18. Drop wire storing and transport apparatus according to claim 17, wherein said means establishing said first path includes feed rails means sloping downwardly toward said unloading position and along which the full magazines may move, and wherein said means establishing said second path includes return rail means sloping downwardly away from said unloading position and along which said empty magazines may move.

19. Drop wire storing and transport apparatus according to claim 18, including swivel rail means at said unloading position and being alternately swivelable into alignment with said feed rail means and with said return rail means.

* * * * *